US011953249B2

(12) United States Patent
Chauhan et al.

(10) Patent No.: US 11,953,249 B2
(45) Date of Patent: Apr. 9, 2024

(54) ICEMAKER ASSEMBLY

(71) Applicant: WHIRLPOOL CORPORATION, Benton Harbor, MI (US)

(72) Inventors: Vishal B. Chauhan, Palghar (IN); Giulia Marinello, Milan (IT); Vikas C. Mruthyunjaya, St. Joseph, MI (US); Kevin Y. Zhang, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 202 days.

(21) Appl. No.: 17/481,546

(22) Filed: Sep. 22, 2021

(65) Prior Publication Data

US 2022/0003476 A1 Jan. 6, 2022

Related U.S. Application Data

(62) Division of application No. 16/399,352, filed on Apr. 30, 2019, now Pat. No. 11,226,146.

(51) Int. Cl.
*F25C 1/04* (2018.01)
*F25C 1/25* (2018.01)

(52) U.S. Cl.
CPC ..... *F25C 1/04* (2013.01); *F25C 1/25* (2018.01); *F25C 2600/04* (2013.01)

(58) Field of Classification Search
CPC ..... F25C 1/04; F25C 1/25; F25C 2600/04
See application file for complete search history.

(56) References Cited

U.S. PATENT DOCUMENTS

| | | | | |
|---|---|---|---|---|
| 1,395,411 | A | 11/1921 | Hessel | |
| 2,717,506 | A | 9/1955 | Andersson | |
| 2,963,885 | A | 12/1960 | Loewenthal | |
| 3,411,554 | A | 11/1968 | Wilson | |
| 3,866,434 | A | 2/1975 | Pugh et al. | |
| 4,274,263 | A | 6/1981 | Goushaw | |
| 6,041,607 | A | 3/2000 | Kim | |
| 6,276,146 | B1 | 8/2001 | Kim | |
| 8,919,145 | B2 | 12/2014 | Bortoletto et al. | |
| 2004/0045600 | A1* | 3/2004 | Hoggard | E03B 7/10 137/61 |
| 2006/0196212 | A1 | 9/2006 | Jenkins, Jr. et al. | |

(Continued)

FOREIGN PATENT DOCUMENTS

| | | | |
|---|---|---|---|
| CN | 209743833 U | * | 12/2019 |
| GB | 2275328 A | | 8/1994 |

(Continued)

OTHER PUBLICATIONS

CN209743833U Translation (Year: 2019).*

*Primary Examiner* — Schyler S Sanks
(74) *Attorney, Agent, or Firm* — Price Heneveld LLP

(57) ABSTRACT

A refrigerator includes a freezer compartment and a machine compartment positioned proximate the freezer compartment. An icemaker assembly is positioned within the freezer compartment. A fill tube extends from the machine compartment into the icemaker assembly. A first solenoid valve is coupled to the fill tube. A second solenoid valve is coupled to the fill tube, wherein the first and second solenoid valves are positioned within the machine compartment. A controller is configured to independently open and close the first and second solenoid valves.

20 Claims, 4 Drawing Sheets

(56) References Cited

U.S. PATENT DOCUMENTS

| | | | | |
|---|---|---|---|---|
| 2006/0249030 | A1* | 11/2006 | Bienvenu | A47J 31/3676 99/291 |
| 2016/0327352 | A1 | 11/2016 | Broadbent et al. | |

FOREIGN PATENT DOCUMENTS

| | | | | |
|---|---|---|---|---|
| KR | 100998198 | B1 | 12/2010 | |
| WO | 2010037193 | A2 | 4/2010 | |
| WO | WO-2010037193 | A2 * | 4/2010 | F25C 1/25 |

* cited by examiner

ICEMAKER ASSEMBLY

CROSS-REFERENCE TO RELATED APPLICATIONS

This application is a divisional of and claims priority to U.S. patent application Ser. No. 16/399,352, filed on Apr. 30, 2019, now U.S. Pat. No. 11,226,146, entitled "ICEMAKER ASSEMBLY," the disclosure to which is hereby incorporated herein by reference in its entirety.

FIELD OF DISCLOSURE

The present disclosure generally relates to an icemaker assembly. More specifically, the present disclosure is related to an icemaker assembly for a refrigerator.

BACKGROUND

Icemaker assemblies are commonly disposed within refrigerated appliances. It is therefore desired to develop an icemaker assembly that drains water remaining within tubing of the icemaker assembly to prevent blockage caused by ice formation, and to provide an unhindered water fill cycle.

SUMMARY

In at least one aspect of the present disclosure, a refrigerator includes a freezer compartment and a machine compartment positioned proximate the freezer compartment. An icemaker assembly is positioned within the freezer compartment. A fill tube extends from the machine compartment into the icemaker assembly. A first solenoid valve is coupled to the fill tube. A second solenoid valve is coupled to the fill tube, wherein the first and second solenoid valves are positioned within the machine compartment. A controller is configured to independently open and close the first and second solenoid valves.

In at least another aspect of the present disclosure, an icemaker assembly for a refrigerator includes a housing and an ice tray positioned within the housing. A fill tube includes a first portion positioned within the housing and a second portion positioned outside of the housing. An outlet tube is coupled to the second portion of the fill tube. A first solenoid valve is coupled to the fill tube, and a second solenoid valve is coupled to the fill tube. The first and second solenoid valves are operable between opened and closed positions.

In at least another aspect of the present disclosure, an icemaker assembly for a refrigerator includes a housing and an ice tray positioned within the housing. A fill tube has first and second ends with first and second portions disposed therebetween. The first end is positioned proximate to the ice tray. The first portion of the fill tube is positioned within the housing and the second portion of the fill tube is positioned outside the housing. A solenoid valve is coupled to the second end of the fill tube and is operable between opened and closed positions. An outlet tube is coupled to the fill tube. A controller is operably coupled to the solenoid valve for controlling the same.

These and other features, advantages, and objects of the present device will be further understood and appreciated by those skilled in the art upon studying the following specification, claims, and appended drawings.

DETAILED DESCRIPTION OF EMBODIMENTS

Figure 1:
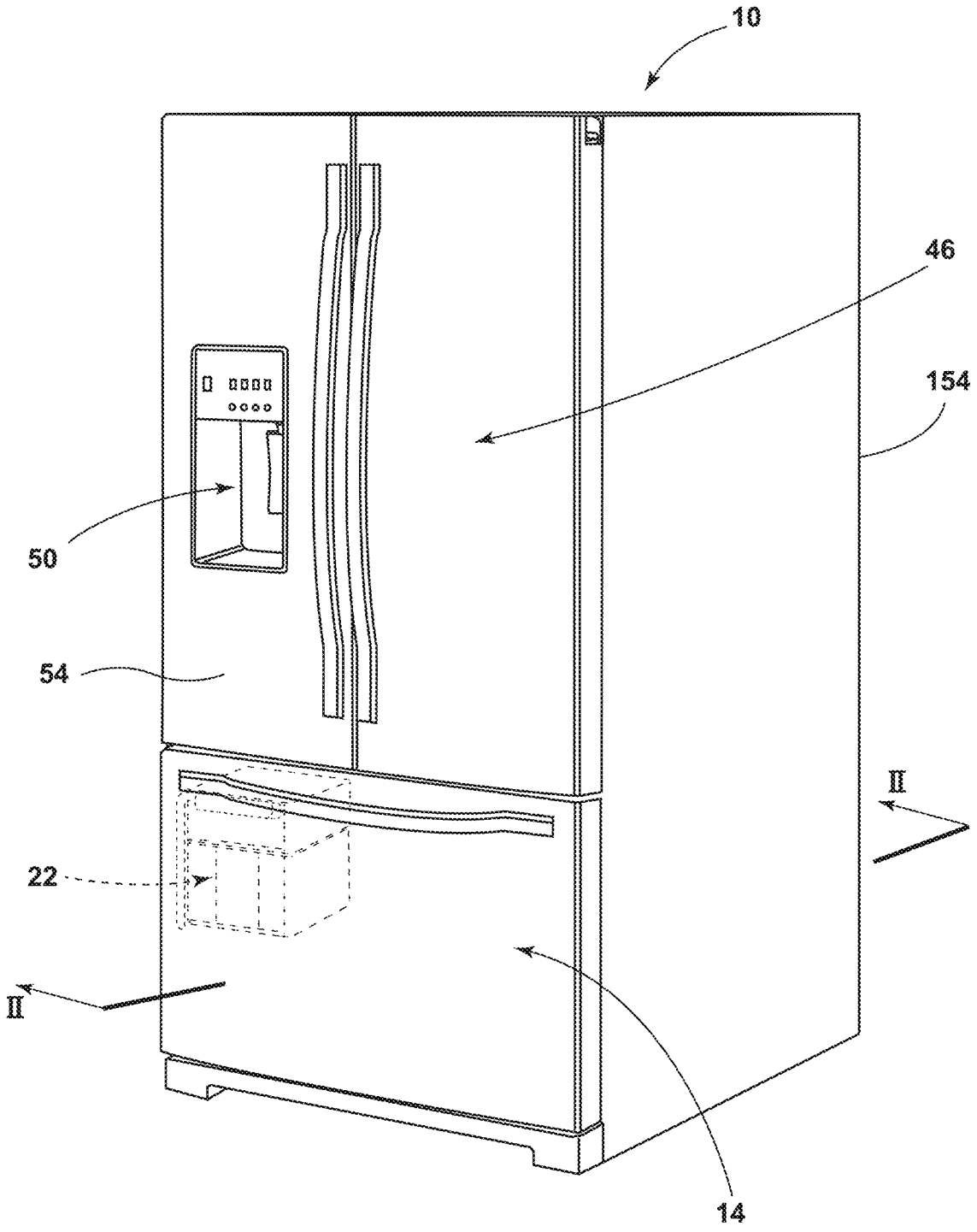
FIG. 1 is a side perspective view of a refrigerator, according to one example.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-4, reference numeral 10 generally designates a refrigerator including a freezer compartment 14. A machine compartment 18 is positioned proximate to the freezer compartment 14. An icemaker assembly 22 is positioned within the freezer compartment 14. A fill tube 30 extends from the machine compartment 18 into the icemaker assembly 22. A first solenoid valve 34 is coupled to the fill tube 30, and a second solenoid valve 38 is coupled to the fill tube 30. The first and second solenoid valves 34, 38 are positioned within the machine compartment 18. A controller 42 is configured to open and close the first and second solenoid valves 34, 38.

Referring to FIG. 1, the refrigerator 10 has a fresh food compartment 46 and a freezer compartment 14, however, other locations within the freezer compartment 14 are contemplated as being suitable for the icemaker assembly 22 of the present concept. The refrigerator 10 is illustrated as a French door bottom mount refrigerator. However, it is contemplated that the refrigerator 10 may be, for example, a bottom mount refrigerator, a top mount refrigerator, a side-by-side refrigerator, a 4-door French door refrigerator, and/or a 5-door French door refrigerator. The refrigerator 10 includes a water dispenser 50 on a door 54 of the fresh food compartment 46. As noted above, the refrigerator 10 further includes the icemaker assembly 22 positioned within the freezer compartment 14.

Figure 2:
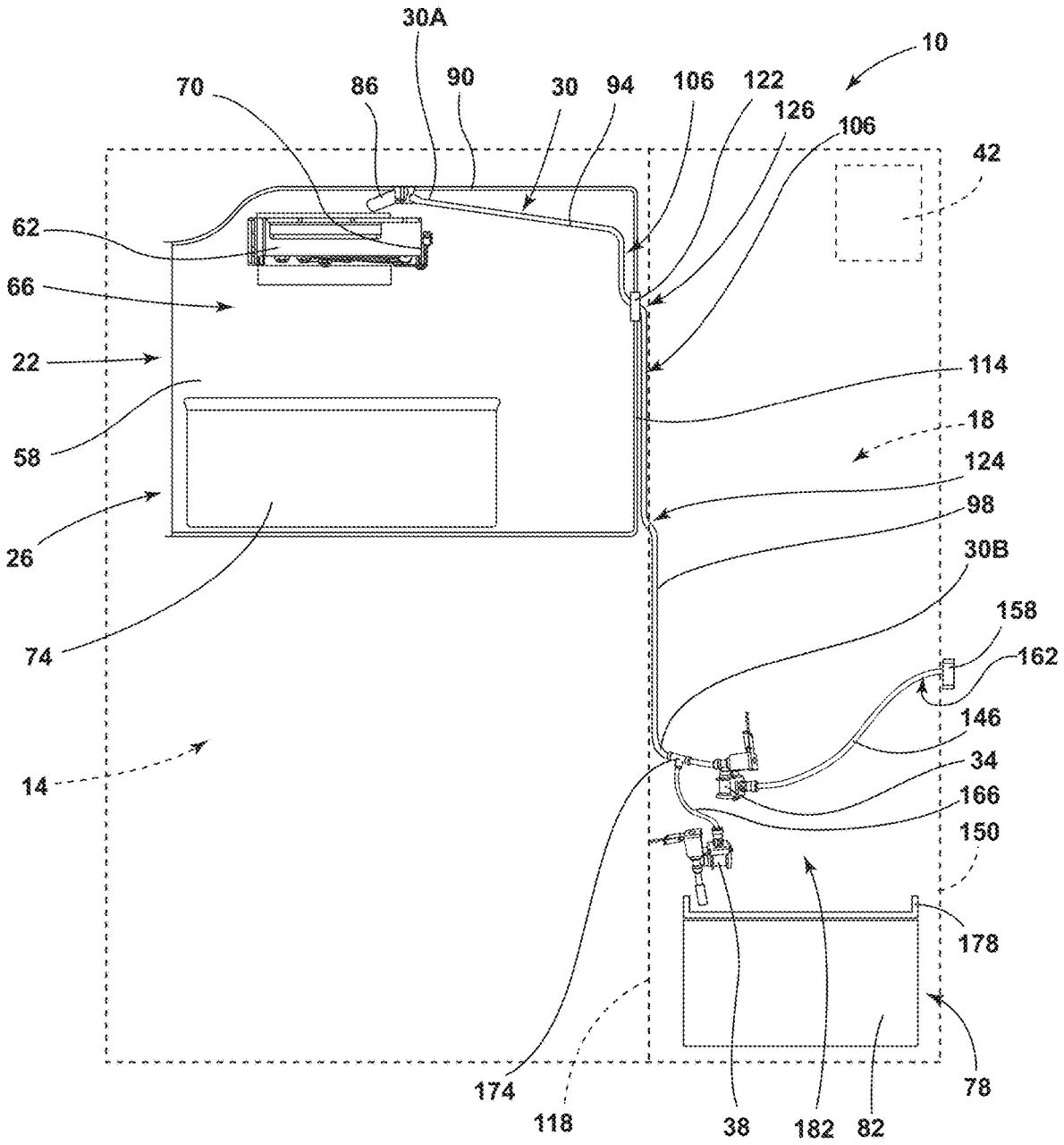
FIG. 2 is a cross-sectional view taken along the line II-II of FIG. 1 of a freezer compartment and machine compartment of the refrigerator, according to one example.

Referring to FIG. 2, the icemaker assembly 22 is in the upper portion 26 of the freezer compartment 14. The icemaker assembly 22 includes a housing 58 and an ice tray 62 positioned in a top portion 66 of the housing 58. As illustrated, the ice tray 62 includes a power connection 70 to power ice cube formation and/or ice cube releasing functions of the ice tray 62. The icemaker assembly 22 further includes an ice storage bin 74 positioned below the ice tray 62. The ice storage bin 74 is configured to receive ice cubes released from the ice tray 62 and store the ice cubes until the ice cubes are dispensed or otherwise retrieved by a user.

In various examples, the machine compartment 18 is positioned proximate or directly adjacent to the freezer compartment 14. As illustrated in the embodiment of FIG. 2, the machine compartment 18 is positioned behind the freezer compartment 14. The machine compartment 18, depicted in FIG. 2, has a height that is substantially similar to a height of the freezer compartment 14. However, it is contemplated that the upper portion 26 of the freezer compartment 14 may extend a greater depth into the refrigerator 10, thereby limiting the height and/or depth of the machine compartment 18. The machine compartment 18 houses a refrigeration system 78, including, for example, an evaporator, a condenser, and a compressor 82.

As illustrated in FIG. 2, the fill tube 30 includes a first end 30A positioned within the housing 58 of the icemaker assembly 22. Specifically, the first end 30A of the fill tube 30 is positioned proximate the ice tray 62 within the icemaker assembly 22. The first end 30A of the fill tube 30 includes a nozzle 86 positioned above the ice tray 62. The nozzle 86 extends at a downward angle from a top surface 90 of the housing 58 in a range of about 15° to about 60°. The nozzle 86, as illustrated in the embodiment of FIG. 2, is coupled to the top surface 90 of the housing 58. It may be advantageous to couple the nozzle 86 to the housing 58 or otherwise secure the nozzle 86 to prevent water flowing through the nozzle 86 from altering the position of the nozzle 86. It is also contemplated that the fill tube 30 may be coupled to the top surface 90 of the housing 58.

The fill tube 30 extends from the machine compartment 18 into the freezer compartment 14, and further extends into the housing 58 of the icemaker assembly 22. A first portion 94 of the fill tube 30 is positioned within the housing 58 of the icemaker assembly 22. A second portion 98 of the fill tube 30 is positioned outside of the housing 58. In other words, the second portion 98 may be at least partially positioned within the machine compartment 18. Further, the second portion 98 may be at least partially positioned within the freezer compartment 14. Additionally, the fill tube 30 includes a second end 30B, which may be positioned within the machine compartment 18. Accordingly, the fill tube 30 has the first and second ends 30A, 30B with the first and second portions 94, 98 disposed therebetween. As illustrated in FIG. 2, the fill tube 30 substantially vertical portions 106 positioned within the housing 58 and within the freezer compartment 14 between a rear surface 114 of the housing 58 and a divider 118 separating the freezer compartment 14 and the machine compartment 18. It is contemplated that the fill tube 30 may have one vertical portion 106 or more than one vertical portions 106.

Referring again to FIG. 2, in various examples, the rear surface 114 of the housing 58 includes a through portion 122. The through portion 122, as illustrated, may have a greater thickness than the rear surface 114 of the housing 58, however, it is contemplated that the through portion 122 may be substantially flush with the rear surface 114 to form a continuous surface. The through portion 122 defines an aperture 126 for the fill tube 30 to extend through the housing 58. The aperture 126 may define a substantially similar cross-sectional shape and size as the fill tube 30, such that the through portion 122 defining the aperture 126 abuts an outer surface 130 of the fill tube 30. Additionally or alternatively, the through portion 122 may include a gasket or other similar structure to seal against the outer surface 130 of the fill tube 30, thereby preventing air in the housing 58 from escaping to the freezer compartment 14. The through portion 122 is shown in FIG. 2 as being coupled to the rear surface 114 of the housing 58, however, it is contemplated that the through portion 122 may be coupled to another surface of the housing 58. Accordingly, it is contemplated that the fill tube 30 may extend into the housing 58 in a different location based on the configuration of the machine compartment 18 and/or the icemaker assembly 22. The fill tube 30 also traverses the divider 118. The divider 118 may also define a gap 124 for the fill tube 30 to traverse the divider 118. The divider 118 may form a seal about the fill tube 30 to prevent cold air from the freezer compartment 14 escaping to the machine compartment 18. The gap 124 may be substantially similar to the through portion 122. Alternatively, there may be a combined through portion 122.

The fill tube 30 is illustrated as extending through the rear surface 114 of the housing 58. Additionally or alternatively, the fill tube 30 extends into the housing 58 below the ice tray 62. It is also contemplated that the fill tube 30 may extend into the housing 58 above or substantially coplanar with the ice tray 62. The first portion 94 of the fill tube 30 positioned within the housing 58 includes a vertical portion 106. Further, the second portion 98 of the fill tube 30 positioned at least partially within the freezer compartment 14 includes a vertical portion 106. The vertical portions 106 of the first and second portions 94, 98 may extend at an upward angle in a range of from about 45° to about 90°. Additionally, the fill tube 30 may include, for example, metal materials, metal alloy materials, and/or plastic materials.

Referring still to FIG. 2, the fill tube 30 is coupled to the first solenoid valve 34 and the second solenoid valve 38 within the machine compartment 18. Accordingly, the first and second solenoid valves 34, 38 are coupled to the second portion 98 of the fill tube 30, which extends into the machine compartment 18. The first and second solenoid valves 34, 38 may additionally or alternatively be coupled to the second end 30B of the fill tube 30. An inlet tube 146 is also coupled to the first solenoid valve 34. As illustrated, the inlet tube 146 extends from a back surface 150 of the machine compartment 18. In various examples, the back surface 150 of the machine compartment may coincide with a rearward surface 154 (FIG. 1) of the refrigerator 10. It is also contemplated that the inlet tube 146 may extend through the back surface 150 of the machine compartment 18 and/or the rearward surface 154 of the refrigerator 10. It is further contemplated that the inlet tube 146 may extend out of another location of the machine compartment 18 and/or refrigerator 10. The inlet tube 146 includes a connector 158 positioned at a rear end portion 162 of the inlet tube 146. The connector 158 is configured to receive an external water supply line that provides water to the inlet tube 146 from a water source within a building (e.g., a house or a workplace).

The fill tube 30 is further coupled to an outlet tube 166. The outlet tube 166, as illustrated, is coupled to the second portion 98 of the fill tube 30 and the second solenoid valve 38. The outlet tube 166 is coupled to the fill tube 30 via a T-joint coupling 174, however, it is contemplated that other coupling members may be used without departing from the teachings herein. The outlet tube 166 is configured to allow water from the fill tube 30 to drain into a drain receptacle 178. The drain receptacle 178 is positioned within a lower portion 182 of the machine compartment 18. As illustrated, the drain receptacle 178 is positioned on the compressor 82 and below the second solenoid valve 38. The drain receptacle 178 may be any size and/or shape container configured to receive water draining from the fill tube 30. The drain receptacle 178 may also be positioned in various locations based on the configuration of the icemaker assembly 22.

Figure 3:
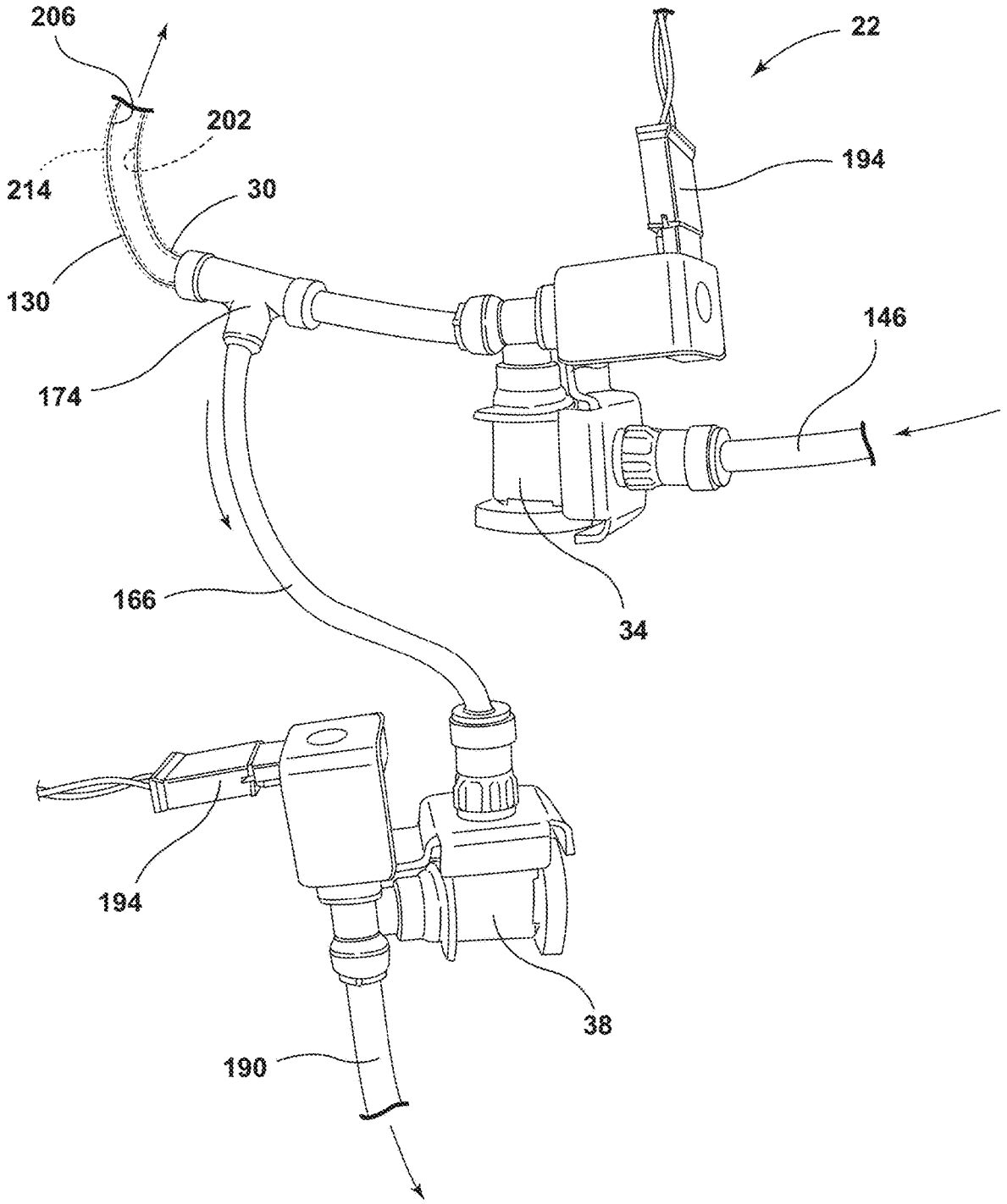
FIG. 3 is a partial side view of an icemaker assembly within the machine compartment, according to one example.

Referring to FIGS. 2 and 3, the controller 42 is operably coupled to the first and second solenoid valves 34, 38 for controlling the same to regulate a fill sequence and a drain sequence of the icemaker assembly 22. As discussed herein, the fill sequence generally supports filling the ice tray 62 of the icemaker assembly 22 with water from a water supply source via interconnected tubes (e.g., the fill tube 30 and/or the inlet tube 146). As discussed herein, the drain sequence generally supports draining water from interconnected tubes between the icemaker assembly 22 and the machine compartment 18 (e.g., the fill tube 30 and/or a drain tube 190). The first and second solenoid valves 34, 38 are independently operable between opened and closed positions. In other words, the controller 42 controls the first and second solenoid valves 34, 38 between the opened and closed positions. The first solenoid valve 34 may be biased to the closed position. The controller 42 is configured to open the first solenoid valve 34 to begin the fill sequence. Once in the opened position, the first solenoid valve 34 allows water to flow from the inlet tube 146 to the fill tube 30. The water travels through the fill tube 30, out the nozzle 86, and is inserted into the ice tray 62. Accordingly, the fill sequence operates to provide water to the ice tray 62. During the fill sequence, the second solenoid valve 38 remains in a closed position. It may be advantageous for the second solenoid valve 38 to be in the closed position during the fill sequence, such that water passing the T-joint coupling 174 continues through the fill tube 30 rather than diverting to the drain tube 190. Additionally, the T-joint coupling 174 may also be configured to prevent water from entering the outlet tube 166 during the fill sequence.

After the fill sequence is complete, the controller 42 is configured to return the first solenoid valve 34 to the closed position and thereby prevent water from entering the fill tube 30. The controller 42 is then configured to open the second solenoid valve 38. The controller 42 may be configured to open the second solenoid valve 38 after a predetermined length of time has passed after the fill sequence is completed. In other words, the controller 42 may open the second solenoid valve 38 a predetermined amount of time after the fill sequence. It may be advantageous to time the opening of the second solenoid valve 38 so the water in the fill tube 30 is not drained prematurely thereby preventing or decreasing ice formation in the ice tray 62. Once the second solenoid valve 38 is in an opened position, gravity operates to move water down the fill tube 30 in an opposite direction of the fill sequence, and through the outlet tube 166. A drain sequence of the icemaker assembly 22 operates to drain remaining water in the fill tube 30 after a fill sequence. The water moves from the fill tube 30, through the outlet tube 166, and is expelled through the second solenoid valve 38 into the drain receptacle 178. In various examples, a drain tube 190 is coupled to the second solenoid valve 38 to direct the water from the second solenoid valve 38 to the drain receptacle 178. However, the water may be expelled directly from the second solenoid valve 38 to the drain receptacle 178 without the drain tube 190. Additionally or alternatively, the first solenoid valve 34 is in the opened position and the second solenoid valve 38 is in the closed position during the fill sequence, and during the drain sequence, the second solenoid valve 38 is in the opened position and the first solenoid valve 34 is in the closed position. It is contemplated that other opening and closing sequences may be used without departing from the teachings herein.

Referring again to FIGS. 2 and 3, the first and second solenoid valves 34, 38 each include an electrical connection 194. The electrical connections 194 couple the first and second solenoid valves 34, 38 to a power source 198 (FIG. 4) within the refrigerator 10. The electrical connections 194 provide an electric current to the first and second solenoid valves 34, 38. The first and second solenoid valves 34, 38 operate to generate a magnetic field from the electric current to open the first and second solenoid valves 34, 38, respectively. The type and/or strength of the first and second solenoid valves 34, 38 may differ based on the icemaker assembly 22 and/or the refrigerator 10.

In various examples, a hydrophobic coating 202 is positioned on an inner surface 206 of the fill tube 30. In various examples, the hydrophobic coating 202 may be coupled to the first and second portions 94, 98 of the fill tube 30. Alternatively, the hydrophobic coating may be coupled to one of the first portion 94 or the second portion 98. It may be advantageous to include the hydrophobic coating 202 on the first and second portions 94, 98 of the fill tube 30 to prevent droplets of water from remaining on the inner surface 206 of the fill tube 30 after the fill and drain sequences. Similarly, it may be advantageous to include the hydrophobic coating 202 on the vertical portions 106 of the fill tube 30. The water droplets may freeze and interfere with subsequent fill and/or drain sequences of the icemaker assembly 22. The hydrophobic coating 202 may further be advantageous when the fill tube 30 includes and/or is formed from plastic materials that may retain water droplets.

Referring still to FIGS. 2 and 3, a heating element 214 is illustrated coupled to the outer surface 130 of the fill tube 30. The heating element 214 may be a layer or coating positioned about the outer surface 130 of the fill tube 30. In various examples, the heating element 214 may be coupled to the first and second portions 94, 98 of the fill tube 30. Alternatively, the hydrophobic coating may be coupled to one of the first portion 94 or the second portion 98. It may be advantageous to include the heating element 214 on the first and second portions 94, 98 of the fill tube 30 or, more specifically, the vertical portions 106 of the fill tube 30 to melt any water that may freeze within the fill tube 30. Water that freezes within the fill tube 30 may prevent additional water from flowing through the fill tube 30 to the ice tray 62 during the fill sequence. Accordingly, the heating element 214 may operate to melt ice within the fill tube 30. In such examples, it may be advantageous for the fill tube 30 to include and/or be formed from metals or metal alloys, such that the fill tube 30 is not damaged by the heating element 214. The heating element 214 may be, for example, a thermally conductive material configured to conduct heat to the fill tube 30.

Figure 4:
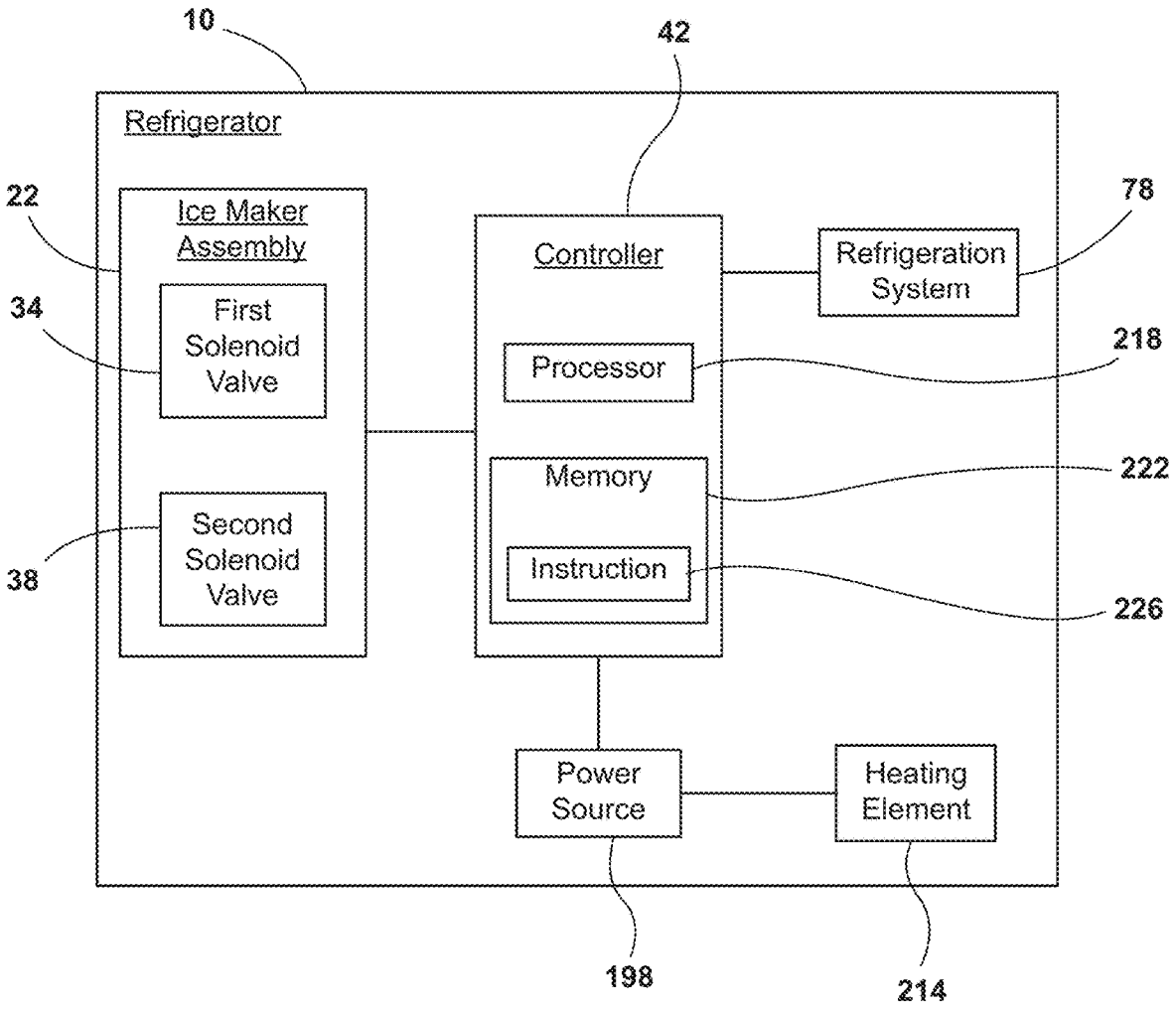
FIG. 4 is a block diagram of the refrigerator, according to one example.

Referring to FIGS. 3 and 4, the heating element 214 is coupled to the power source 198. The power source 198 is configured to activate the heating element 214. In various examples, the controller 42 activates the power source 198 which then conducts heat through the heating element 214. The power source 198 may be the same power source 198 for the refrigerator 10 or may be a separate power source 198. In various examples, the fill tube 30 may include the heating element 214, the hydrophobic coating 202, and/or a combination thereof. It is also contemplated that the fill tube 30 does not include the hydrophobic coating 202 or the heating element 214. The controller 42 may also be configured to activate the heating element 214 and/or the power source 198 before or after one of a fill sequence and a drain sequence. Additionally or alternatively, the controller 42 may be configured to activate the heating element 214 and/or power source 198 after a predetermined amount of time after the completion of one of the fill sequence and/or the drain sequence. Additionally or alternatively still, the controller 42 may be configured to activate the heating element 214 and/or power source 198 during one of the fill sequence and drain sequence.

Referring to FIG. 4, the controller 42 includes a processor 218, other control circuitry, and a memory 222. Stored in the memory 222 and executable by the processor 218 are instructions 226. The memory 222 may store various instructions 226 relating to various functions. For example, the instructions 226 include at least one instruction 226 relating to the functions of the refrigeration system 78. The instructions 226 may also include at least one instruction 226 for starting and/or stopping the fill sequence and the drain sequence of the icemaker assembly 22. The controller 42 may also be operably coupled to the first and second solenoid valves 34, 38. In various examples, the controller 42 is configured to open and close the first and second solenoid valves 34, 38. The controller 42 may be configured to open the second solenoid valve 38 after a predetermined length of time from completion of the fill sequence. In such examples, the controller 42 is configured to open the second solenoid valve 38 to drain water from the fill tube 30 via the outlet tube 166 during the drain sequence.

Use of the present concept may provide for a variety of advantages. For example, the fill tube 30 may include the vertical portions 106 positioned within at least one of the housing 58 and the freezer compartment 14. In such examples, water may remain in the vertical portions 106 or other locations within the fill tube 30. The icemaker assembly 22 disclosed herein may drain water from the fill tube 30 and reduce the amount of water that may remain, and freeze, within the fill tube 30. Additionally, the fill tube 30 may include the hydrophobic coating 202 on the inner surface 206 of the fill tube 30. The hydrophobic coating 202 may reduce water droplets that remain on the inner surface 206 of the fill tube 30. In a third example, the heating element 214 may be coupled to the fill tube 30. The heating element 214 may conduct heat to the fill tube 30 and melt ice that may remain within the fill tube 30. Further, use of the presently disclosed icemaker assembly 22, including the first and second solenoid valves 34, 38 and/or the hydrophobic coating 202, may reduce the use of the heating element 214, which may reduce energy consumption. Additional benefits or advantages of using this device may also be realized and/or achieved.

According to at least one aspect, a refrigerator includes a freezer compartment and a machine compartment positioned proximate the freezer compartment. An icemaker assembly is positioned within the freezer compartment. A fill tube extends from the machine compartment to the icemaker assembly. A first solenoid valve is coupled to the fill tube. A second solenoid valve is coupled to the fill tube, wherein the first and second solenoid valves are positioned within the machine compartment. A controller is configured to independently open and close the first and second solenoid valves.

According to another aspect, a drain receptacle is positioned within the machine compartment and configured to receive water from the second solenoid valve.

According to another aspect, a substantially vertical portion of the fill tube is positioned within the freezer compartment.

According to still another aspect, an outlet tube is coupled to the fill tube via a T-joint coupling.

According to another aspect, the first solenoid valve is in an opened position during a fill sequence and the second solenoid valve is in a closed position during the fill sequence.

According to another aspect, the second solenoid valve is in an opened position during a drain sequence and the first solenoid valve is in a closed position during the drain sequence.

According to yet another aspect, the controller opens the second solenoid valve a predetermined amount of time after a fill sequence.

According to at least one aspect, an icemaker assembly for a refrigerator includes a housing and an ice tray positioned within the housing. A fill tube includes a first portion positioned within the housing and a second portion positioned outside of the housing. An outlet tube is coupled to the second portion of the fill tube. A first solenoid valve is coupled to the fill tube, and a second solenoid valve is coupled to the fill tube, wherein the first and second solenoid valves are operable between opened and closed positions.

According to another aspect, the first and second solenoid valves are coupled to the second portion of the fill tube.

According to still another aspect, a hydrophobic coating is positioned on an inner surface of the fill tube.

According to another aspect, an inlet tube is coupled to the first solenoid valve.

According to yet another aspect, the first solenoid valve is in the closed position during a drain sequence.

According to another aspect, a controller configured to control the first and second solenoid valves between the opened and closed positions.

According to another aspect, the controller is configured to open the second solenoid valve a predetermined amount of time after completion of a fill sequence.

According to another aspect, the outlet tube is coupled to the fill tube via a T-joint coupling, and further wherein the T-joint coupling is configured to prevent water from entering the outlet tube during a fill sequence.

According to at least one aspect, an icemaker assembly for a refrigerator includes a housing and an ice tray positioned within the housing. A fill tube has first and second ends with first and second portions disposed therebetween. The first end is positioned proximate to the ice tray. The first portion of the fill tube is positioned within the housing and the second portion of the fill tube is positioned outside the housing. A solenoid valve is coupled to the second end of the fill tube. An outlet tube is coupled to the fill tube. A controller is operably coupled to the solenoid valve for controlling the same.

According to another aspect, the fill tube includes a metal material.

According to yet another aspect, a heating element is coupled to an outer surface of the fill tube.

According to still another aspect, a power source is coupled to the heating element, wherein the power source is configured to activate the heating element before or after one of a fill sequence and a drain sequence.

According to another aspect, the controller is configured to open the solenoid valve to drain water from the fill tube via the outlet tube during a drain sequence.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An icemaker assembly for a refrigerator, comprising:
- a housing;
- an ice tray positioned within the housing;
- a fill tube having a first end positioned within the housing proximate to the ice tray and a second end positioned outside of the housing;
- an outlet tube coupled to a second portion of the fill tube;
- a first solenoid valve coupled to the fill tube;
- a second solenoid valve coupled to the fill tube, wherein the first and second solenoid valves are operable between opened and closed positions; and
- a controller configured to control the first and second solenoid valves between the opened and closed positions, wherein the controller is configured to open the second solenoid valve a predetermined amount of time after completion of a fill sequence.

2. The icemaker assembly of claim 1, wherein the first and second solenoid valves are coupled to the second end of the fill tube via a T-joint coupling.

3. The icemaker assembly of claim 1, further comprising:
- a hydrophobic coating positioned on an inner surface of the fill tube.

4. The icemaker assembly of claim 1, further comprising:
- an inlet tube coupled to the first solenoid valve.

5. The icemaker assembly of claim 1, wherein the first solenoid valve is in the closed position during a drain sequence.

6. The icemaker assembly of claim 1, wherein the outlet tube is coupled to the fill tube via a T-joint coupling, and further wherein the T-joint coupling is configured to prevent water from entering the outlet tube during the fill sequence.

7. The icemaker assembly of claim 1, wherein the second portion is positioned outside of the housing.

8. The icemaker assembly of claim 1, wherein the fill tube includes a vertical portion within the housing.

9. The icemaker assembly of claim 8, wherein the vertical portion extends at an upward angle from 45° to 90°.

10. The icemaker assembly of claim 1, wherein the first solenoid valve and the second solenoid valve are operably coupled to the second portion of the fill tube outside of the housing.

11. The icemaker assembly of claim 1, wherein the first and second solenoid valves are independently operable between the opened and closed positions.

12. The icemaker assembly of claim 1, wherein, when the first solenoid valve is in the opened position, water is configured to travel through the fill tube and to the ice tray.

13. The icemaker assembly of claim 1, wherein the controller is configured to adjust the first solenoid valve to the closed position after the completion of the fill sequence.

14. The icemaker assembly of claim 1, wherein, during a drain sequence, the second solenoid valve is in the opened position.

15. The icemaker assembly of claim 14, wherein, during the drain sequence, water is configured to move from the fill tube, through the outlet tube, and is expelled through the second solenoid valve.

16. The icemaker assembly of claim 15, further comprising:
- a drain receptacle positioned outside the housing, wherein the water is configured to be expelled from the second solenoid valve and into the drain receptacle.

17. The icemaker assembly of claim 1, further comprising:
- a heating element coupled to an outer surface of the fill tube.

18. The icemaker assembly of claim 17, further comprising:
- a power source configured to activate the heating element, wherein the power source is coupled to the first solenoid valve and the second solenoid valve via electrical connections.

19. The icemaker assembly of claim 1, further comprising:
- a T-joint coupling coupled to the second end of the fill tube, wherein the outlet tube is coupled to the second portion of the fill tube via the T-joint coupling.

20. The icemaker assembly of claim 19, further comprising:
- an inlet tube coupled to the T-joint coupling.

* * * * *